US011470695B2

(12) United States Patent
Kunkee et al.

(10) Patent No.: US 11,470,695 B2
(45) Date of Patent: Oct. 11, 2022

(54) FILTER WITH AN ENCLOSURE HAVING A MICROMACHINED INTERIOR USING SEMICONDUCTOR FABRICATION

(71) Applicant: Northrop Grumman Systems Corporation, Falls Church, VA (US)

(72) Inventors: Elizabeth T Kunkee, Manhattan Beach, CA (US); Dah-Weih Duan, Torrance, CA (US); Dino Ferizovic, Torrance, CA (US); Chunbo Zhang, Manhattan Beach, CA (US); Greta S Tsai, Los Angeles, CA (US); Ming-Jong Shiau, Cerritos, CA (US); Daniel R Scherrer, Glendale, CA (US); Martn E Roden, Long Beach, CA (US)

(73) Assignee: NORTHROP GRUMMAN SYSTEMS CORPORATION, Falls Church, VA (US)

( * ) Notice: Subject to any disclaimer, the term of this patent is extended or adjusted under 35 U.S.C. 154(b) by 292 days.

(21) Appl. No.: 16/860,642

(22) Filed: Apr. 28, 2020

(65) Prior Publication Data

US 2021/0337638 A1 Oct. 28, 2021

(51) Int. Cl.
*H05B 6/68* (2006.01)
*H05B 6/80* (2006.01)
*H01P 1/205* (2006.01)

(52) U.S. Cl.
CPC ..... *H05B 6/686* (2013.01); *H05B 6/80* (2013.01); *H01P 1/2053* (2013.01)

(58) Field of Classification Search
CPC ..... H05B 6/686; H05B 6/80; H05K 1/113; H05K 1/115; G01S 7/13; G01S 7/17
See application file for complete search history.

(56) References Cited

U.S. PATENT DOCUMENTS 5,319,329 A 6/1994 Shiau et al.
6,522,214 B1 2/2003 Harju et al.
(Continued)

FOREIGN PATENT DOCUMENTS

CN 101420056 4/2009
CN 108598638 9/2018
(Continued)

OTHER PUBLICATIONS

International Search Report in related Application Serial No. PCT/US2021/031224, dated Jul. 19, 2021, 27 pages.
(Continued)

*Primary Examiner* — Abdullah A Riyami
*Assistant Examiner* — Syed M Kaiser
(74) *Attorney, Agent, or Firm* — McCracken & Gillen LLC

(57) ABSTRACT

An exemplary semiconductor technology implemented microwave filter includes a dielectric substrate with metal traces on one surface that function as frequency selective circuits and reference ground. Other metal traces on the other surface of the substrate also provide reference ground. Bottom and top enclosures that enclose the substrate have respective interior recesses with deposited continuous metal coatings. A plurality of metal bonding bumps or bonding wall extends outwardly from the projecting walls of the bottom and top enclosures. The bonding bumps on the bottom and top enclosures engage reference ground metal traces on respective surfaces of the substrate. As a result of applied pressure, the bonding bumps and respective reference ground metal traces together with the through-substrate vias form a metal-to-metal singly-connected ground reference structure for the entire circuitry.

15 Claims, 8 Drawing Sheets

(56) References Cited

U.S. PATENT DOCUMENTS

| | | | | |
|---|---|---|---|---|
| 6,734,750 | B1 | 5/2004 | Ostergaard | |
| 9,627,736 | B1 | 4/2017 | Ingalls | |
| 9,761,547 | B1 | 9/2017 | Kunkee et al. | |
| 9,865,909 | B2 | 1/2018 | Chan | |
| 2003/0206261 | A1 | 6/2003 | Cahill | |
| 2007/0048898 | A1 | 3/2007 | Carlson et al. | |
| 2008/0001241 | A1* | 1/2008 | Tuckerman | H01L 31/0203 257/434 |
| 2008/0002460 | A1* | 1/2008 | Tuckerman | H01L 31/0203 257/E23.079 |
| 2012/0094442 | A1* | 4/2012 | Lin | H05K 1/021 438/118 |
| 2018/0352651 | A1* | 12/2018 | Tazzoli | G01S 7/4813 |
| 2020/0091608 | A1* | 3/2020 | Alpman | H01Q 25/001 |
| 2020/0075503 | A1 | 5/2020 | Chuang et al. | |

FOREIGN PATENT DOCUMENTS

| | | | | |
|---|---|---|---|---|
| CN | 108074872 B | * | 7/2020 | H01L 21/486 |
| WO | WO-2007103224 A2 | * | 9/2007 | B81C 1/00301 |
| WO | WO 2016133457 | | 8/2016 | |

OTHER PUBLICATIONS

Hsieh et al., Design of Ku-Band SIR Interdigital Bandpass Filter Using Silicon-Based Micromachining Technology, Silicon Monolithic Integrated Circuits in RF Systems (SIRF), 2010 Topical Meeting On, IEEE, Jan. 11, 2010, pp. 104-107.

Mokhtaari et al., Ultra-wideband and notched wideband filters with grounded vias in microstrip technology, Microwave Conference, 2008 AMPC 20008 Asia-Pacific, IEEE, Dec. 16, 2008, pp. 1-4.

Stephen V. Robertson et al., Micromachined Self-Packaged W-Bandpass Filters, IEEE MTT-S International Microwave Symposium Digest. Orlando, May 16-20, 1995; IEEE MTT-S International Microwave Symposium Digest, May 16, 1995, vol. 3, pp. 1543-1546.

Soon Young Eom et al., Compact Broadband Microstrip Crossover With Isolation Improvement and Phase Compensation, IEEE Microwave and Wireless Components Letters, vol. 24, No. 7, Jul. 2014, pp. 481-483.

Jeong-Geun Kim et al., Miniature Four-Way and Two-Way 24 GHz Wilkinson Power Dividers in 0.13 μm CMOS, IEEE Microwave and Wireless Components Letters, vol. 17, No. 9, Sep. 2007, pp. 658-660.

Adel A. M. Saleh, Planar Electrically Symmetric n-Way Hybrid Power Dividers/Combiners, IEEE Transactions on Microwave Theory and Techniques, vol. MTT-28, No. 6, Jun. 1980, pp. 555-563.

Soumendu Sinha, et al., Design and Optimization of RF MEMS T-Type Switch for Redundancy Switch Matrix Applications, 2012 International Conference on Computing, Electronics and Electrical Technologies [ICCEET], 2012, pp. 501-508.

Yana Taryana et al., Four Way Power Divider Using Wilkinson Method for X-Band Radar, 2019 International Conference on Radar, Antenna, Microwave, Electronics, and Telecommunications, 2019, pp. 41-15.

Ernest J. Wilkinson, An N-Way Hybrid Power Divider, IRE Transactions on Microwave Theory and Techniques, Jan. 1960, pp. 116-118.

Liu Xin et al., A Novel Compact Planar Crossover With Simple Design Procedure, Proceedings of Asia-Pacific Microwave Conference 2010, pp. 1633-1636.

Song Lin, Development of an Ultra-Wideband Suspended Stripline to Shielded Microstrip Transition, IEEE Microwave and Wireless Components Letters, vol. 21, No. 9, Sep. 2011, pp. 474-476.

Young-Gon Kim and Kang Wook Kim, A New Design Method for Ultra-Wideband Microstrip-to-Suspended Stripline Transitions, Machine Copy for Proofreading, vol. x, y-z, 2013, pp. 1-14.

Dr. Burhan Bayraktaroglu, Heterogeneous Integration Technology, Final Report, Aug. 2017, 108 pages.

Yuan Li, Pete L. Kirby, and John Papapolymerou, Silicon Micromachined W-Band Bandpass Filter Using DRIE Technique, Proceedings of the 36th European Microwave Conference, Sep. 2006, Manchester UK, pp. 1271-1273.

John C. Tippet and Ming J. Shiau, Circuit Transformations for Realization of a Class of Miniature Printed Circuit Filters, IEEE MTT-S Digest, 1994, pp. 621-624.

Mingqi Chen, A 1-25 GHz GaN HEMT MMIC Low-Noise Amplifier, IEEE Microwave and Wireless Components Letters, vol. 20, No. 10, Oct. 2010, pp. 563-565.

Yemin Tang, et al., Ultra Deep Reactive Ion Etching of High Aspect-Ratio and Thick Silicon Using a Ramped-Parameter Process, Journal of Microelectromechanical Systems, vol. 27, No. 4, Aug. 2018, pp. 686-697.

Vesna Radisic, et al., Heterogeneously Integrated V-Band Amplifier, IEEE/MTT-S International Microwave Symposium, 2018, pp. 289-292.

Wolfgang Menzel, Quasi-Lumped Suspended Stripline Filters and Diplexers, IEEE Transactions on Microwave Theory and Techniques, vol. 53, No. 10, Oct. 2005, pp. 3230-3237.

Kenjiro Nishikawa, et al., Compact 60-GHz LTCC Stripline Parallel-coupled Bandpass Filter with Parasitic Elements for Millimeter-wave System-on-Package, NTT Network Innovation Laboratories, NTT Corporation, Japan, IEEE, 2007, pp. 1649-1652.

Jian-Xing Zhuang, Silicon Micromachined Terahertz Bandpass Filter With Elliptic Cavities, IEEE Transactions on Terahertz Science and Technology, vol. 5, No. 6, Nov. 2015, pp. 1040-1047.

Jiunnjye Tsaur, et al., A Ground Shielded Low Loss Transmissi163-166on Line Using Au-To-Au Therm0 Compressive Packaging for RF Applications, IEEE, 2005, pp. 163-166.

International Search Report in related Application Serial No. PCT/US2021/015211, dated Apr. 20, 2021, 28 pages.

Invitation To Pay Additional Fees in related Application Serial No. PCT/US2022/015204, dated May 23, 2022, 16 pages.

International Search Report in related Application Serial No. PCT/US2022/016263, dated Jul. 22, 2022, 20 pages.

International Search Report in related Application Serial No. PCT/US2022/015205, dated Jul. 14, 2022, 22 pages.

* cited by examiner

FILTER WITH AN ENCLOSURE HAVING A MICROMACHINED INTERIOR USING SEMICONDUCTOR FABRICATION

BACKGROUND

Embodiments of the invention relate to filters made using semiconductor fabrication technology with an enclosure composed of micromachined interiors that enhance the performance of the filters and provide manufacturability that yields repeatable performance results.

High-frequency, i.e. frequencies of 1 GHz and higher, filters have been constructed using a variety of materials and techniques. However, producing filters with a high Q and low insertion loss that are stable over temperature extremes is challenging. It is further challenging to design such high-frequency filters to be able to be manufactured to repeatedly yield virtually the same performance characteristics. There exists a need for filters that substantially overcome these challenges and methods to make such filters.

SUMMARY

It is an object of embodiments of the present invention to provide filters that substantially satisfy these challenges.

An exemplary semiconductor technology implemented high frequency filter includes a dielectric substrate with metal traces on one surface that function as frequency selective circuits and a reference ground. Other metal traces on the other surface of the substrate also provide reference ground. Bottom and top enclosures that enclose the substrate have respective interior recesses with deposited continuous metal coatings. A plurality of metal bonding bumps extends outwardly from the projecting walls of the bottom and top enclosures. The bonding bumps on the bottom and top enclosures engage reference ground metal traces on respective surfaces of the substrate. As a result of applied pressure, the bonding bumps and respective reference ground metal traces form metal-to-metal conductive bonds that together with the through-substrate vias establish a common reference ground among the reference ground metal traces and the deposited metal interior coatings of the bottom and top enclosures.

An exemplary method for manufacturing enclosures for a semiconductor technology implemented high frequency filter having frequency selective circuitry disposed on a substrate that contains reference ground metal traces on each major surface is provided. A substrate is contained as a sandwich between two such manufactured enclosures. A first pattern of dots of photoresist is applied on a silicon wafer within areas on which the ends of walls of the enclosures will be formed. A layer of silicon not protected by the first pattern of photoresist is etched away leaving a plurality of extending bumps and then the first pattern of photoresist that covered the bumps is removed. An oxide coating is deposited to cover the surface of the silicon wafer including the extending bumps. A second pattern of photoresist is applied on the oxide coating on areas that define where the ends of walls will extend from the enclosures; the extending bumps residing within the second pattern. The deposited oxide coating not protected by the second pattern of photoresist is etched away and the second pattern of photoresist that covers areas that will define the walls is removed. A layer of the silicon wafer is etched away except for the areas with the oxide coating that define the ends of the walls to form at least one interior recess in the silicon wafer. The oxide coating is removed from the areas that define the ends of the walls and the bumps. The entirety of the exposed surface of the silicon wafer is sputtered with gold so that sputtered gold coats the ends of the walls, the bumps on the ends of the walls, all interior recesses in the silicon wafer, and the interior sides of the walls. The area covered by sputtered gold is plated with gold.

DESCRIPTION OF THE DRAWINGS

Features of exemplary embodiments of the invention will become apparent from the description, the claims, and the accompanying drawings in which:

DETAILED DESCRIPTION

One aspect of the present invention resides in the recognition of the difficulties associated with repeatably manufacturing a conductive two-piece enclosure to enclose a substrate that can provide an effective ground structure for currents along the entirety of the interfacing peripheries as well as in the interior walls of the cavities. The recognition of such difficulties give rise to an enclosure design that can be reliably and repeatedly manufactured to provide an effective continuous ground structure about the periphery of the assembled enclosure as well as linking top and bottom metallization ground traces. Details concerning the overcoming of these difficulties will be recognized by those of ordinary skill in the art in view of the following description.

The exemplary embodiment of a diplexer is used as an example to convey the features and improvements associated with embodiments of the present invention. A diplexer functions as one type of filter which separates an incoming signal at a single input into two separate outputs, with one output containing input signals having a frequency within a first frequency range and the other output containing input signals having a frequency within a second frequency range, where the first and second frequency ranges are different. As used herein, "filter" is utilized to refer to any type of frequency selective circuitry in RF, microwave or millimeter wave regime suitable for disposition on a substrate that can be disposed within an enclosure. For example, a filter can include, but is not limited to, a diplexer, low pass filter, high pass filter, bandpass filter, multi-function filters, multi-band filters, power dividers/combiners, resonators, couplers, spiral/coil/toroid inductors, metal-insulator-metal (MIM) capacitors, interdigitated capacitors, vertical (i.e., between-via) capacitors, baluns, attenuators, phase shifters, any layer-to-layer transitions, same layer but line type to line type transitions, etc.

Figure 1:
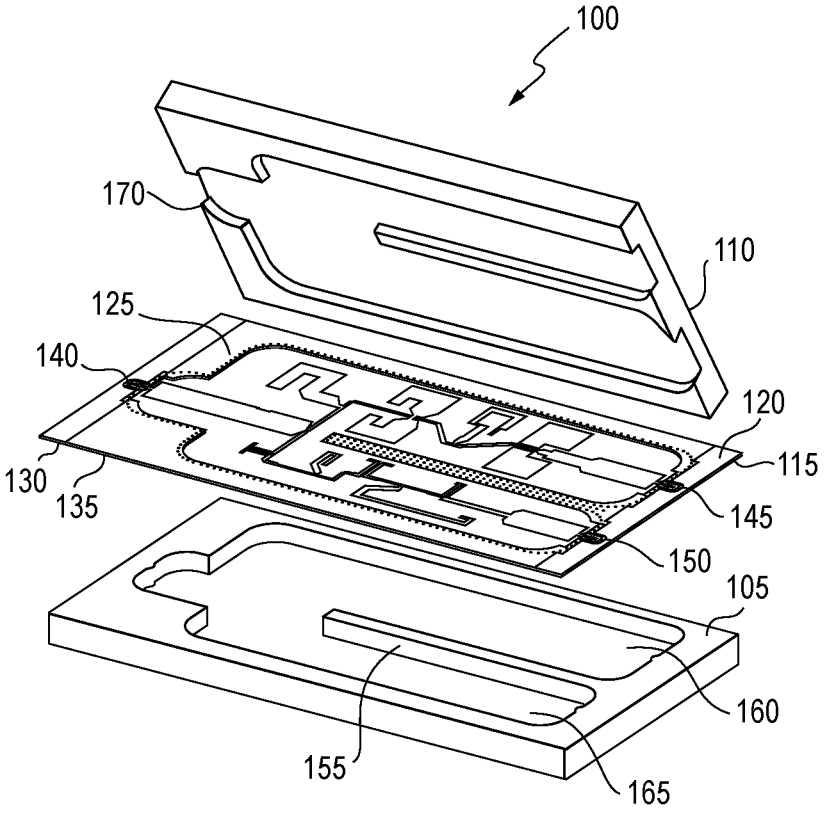
FIG. 1 shows a disassembled perspective view of a filter in accordance with an embodiment of the present invention.

FIG. 1 shows an exemplary embodiment 100 of a filter, i.e. diplexer, having a two-piece enclosure consisting of a bottom enclosure 105 and a top enclosure 110. A substantially planar substrate 115 is sized to be encapsulated like a sandwich between the bottom enclosure 105 and the top enclosure 110 in a ready-for-operation assembly. The substrate 115 has a top surface 120 that supports top metallization 125 and a bottom surface 130 that supports bottom metallization 135. An input port 140 receives the input signal with frequency selective circuitry routing signals in one frequency range to output port 145 while frequencies of another frequency range are routed to output port 150. The bottom enclosure 105 contains an internal recessed area that is partially divided by a longitudinal centered peninsula 155 that separates a recessed area 160 which is associated with output port 145 and recessed area 165 which is associated with output port 150. The upper peripheral surfaces on both the bottom enclosure 105 and the upper surface of peninsula 155 represent a reference ground (potential). The top enclosure 110 is substantially similar to the bottom enclosure except that a cutout portion 170 is disposed to be adjacent to the input port 140 in the assembled position. The cutout portion 170 facilitates the coupling of an input signal by an external probe or line by providing a mechanical support to the input port 140 on the substrate 115. Similarly, cutout portions in the top enclosure opposite the output ports 145 and 150 facilitate clearance for connections with these ports. When assembled, the peninsula 155 engages the substrate 115 on one surface and the corresponding peninsula on the top enclosure engages the substrate 115 on the other surface so as to oppose peninsula 155 and, when interconnected by the through-substrate vias, form two parallel recessed cavities separated by two opposing peninsulas. The grounding structure formed by the two peninsula and the through-substrate vias serves as the microwave isolation wall between the two recessed cavities ("channels") in this exemplary filter. Note that a peninsula is an interior wall in a cover. A cover could also have "islands" in addition to peninsulas. When the interior and the projecting surfaces of a cover are metallized, islands and peninsula are also metalized likewise at the same time. They provide "inner" interior walls, typically for the purpose of isolation, demoding, field-shaping and impedance control. It should be noted that the interior walls including those contributed by the islands and peninsula, the recessed surfaces, the projecting surfaces and the bonding bumps of both covers and the through-substrate vias are all part of the ground reference structure. When assembled, these form a singly connected ground structure, or a "Faraday cage", for the enclosed stripline circuit. Islands and peninsula may have any different, contoured perimeters, which presents no difficulty to the manufacturing technology.

The exemplary diplexer 100 is designed to route input signals at input port 140 with frequencies that are between 0.5 GHz to 10 GHz along a first path to a first output 145 while separating input signals that are between 11 GHz to 20 GHz along a second path to a second output 150. Circuitry associated with the first and second paths provide low insertion loss for the signals that are to be coupled to the respective first and second outputs while providing a substantially high impedance to the other signals that are not desired to be coupled through the respective paths. At such frequencies the exemplary circuitry is implemented by respective metallization traces that function as the equivalent of capacitors, inductors and transmission lines to provide frequency selection.

Figure 2:
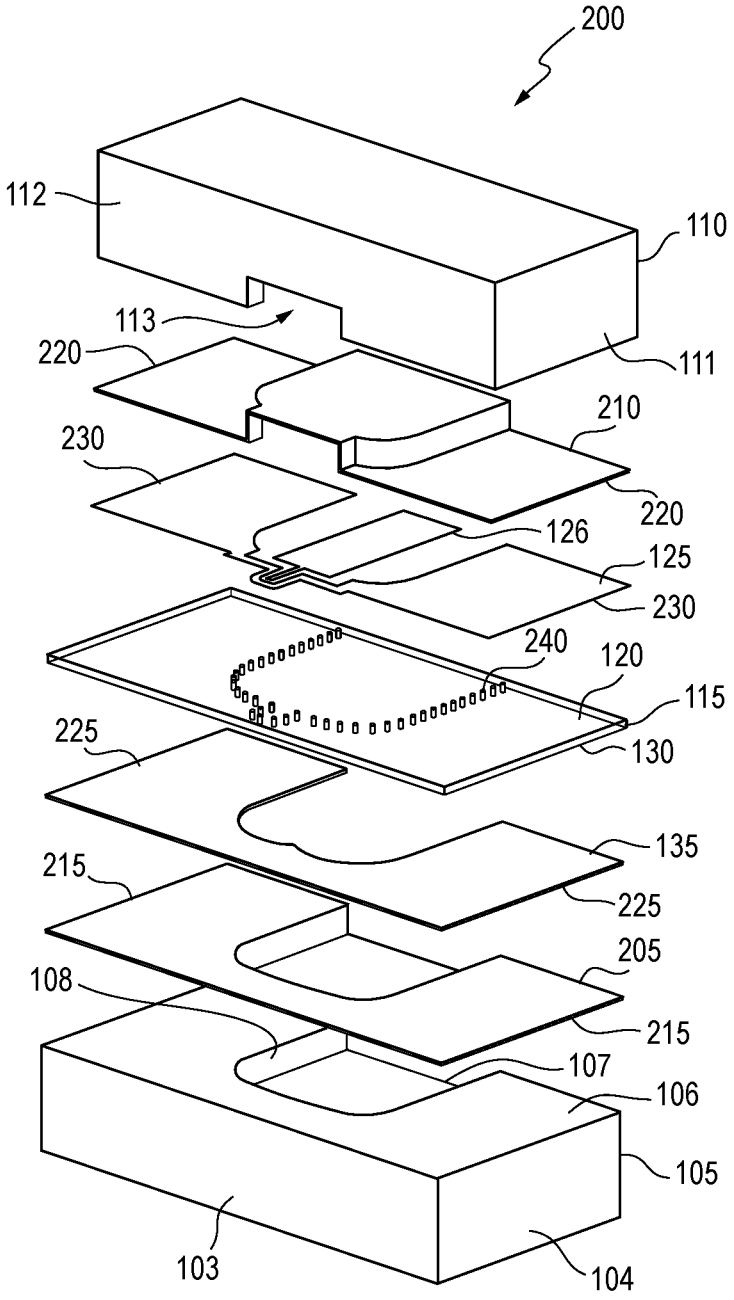
FIG. 2 shows an exploded view of a filter in accordance with an embodiment of the present invention showing the relationship among elements and layers.

FIG. 2 shows a representative exploded view of the exemplary filter (diplexer) 200 in which the elements described in FIG. 1 are shown and identified by the same reference numerals. Bottom layer 205 and top layer 210 represent deposited conductive metal layers on the interior surfaces of the bottom enclosure 105 and top enclosure 110, respectively. The longitudinal peripheries 215 of bottom layer 205 and the longitudinal peripheries 220 of top layer 210 extend to longitudinal edges of the internal surfaces of the bottom enclosure 105 and top enclosure 110, respectively. Likewise, the longitudinal peripheries 225 of bottom metallization 135 and the longitudinal peripheries 230 of top metallization 125 extend to the longitudinal edges of the internal surfaces of bottom enclosure 105 and top enclosure 110, respectively. The peripheries 225 and 230 of the bottom and top metallization layers 135 and 125 on the substrate represent metallization for which reference ground is desired. The top metallization layer also includes signal traces 126 that transport the input signal relative to the reference ground. A plurality of metallized through-hole vias 240 along the longitudinal peripheries of substrate 120 provide an effective ground connection between respective mating areas of mating bottom and top metallization layers 135 and 125. In order to establish an effective ground, the vias 240 should be of suitable spacing for the electromagnetic frequency under consideration in order to prevent moding, which is an undesired electromagnetic resonance that occurs in the empty space ("cavity") formed by surrounding vias when energy of the resonant frequency of that cavity is coupled into the cavity. Typically, the via spacing is chosen to be no more than a small fraction, say, ⅕ to 1/10 of a quarter wavelength (one fourth of a wavelength) of the highest frequency under consideration. For example, to prevent moding at frequencies under 20 GHz, a spacing of 750 μm to 375 μm will suffice. In order to enhance the effective grounding, vias 240 are disposed interior within substrate 120 to engage close to the interior edges of the ground metallization of the bottom metallic layer 135 and also with opposing ground areas on the top metallic layer 125. The bottom deposited metal layer 205 is contiguous within the internal surfaces of the bottom enclosure 105. That is, a continuous deposited metal layer exists on the top surface 106, the top 107 of an interior recess that defines an interior space, and the substantially vertical sidewalls 108 between surfaces 106 and 107. The top deposited metal layer 210 is also contiguous as similarly explained for the bottom deposited metal layer. The bottom enclosure 105 includes 2 longitudinal sidewalls 104 and 2 end walls 103 that are perpendicular to the sidewalls. The top enclosure 110 includes 2 longitudinal sidewalls 111 and 2 end walls 112 that are perpendicular to the sidewalls 111. In the illustrated diplexer example, open portions 113 in the end walls 112 extend from the outside edge of the end wall substantially perpendicular back into the interior to adjoin the major interior recesses.

Figure 3:
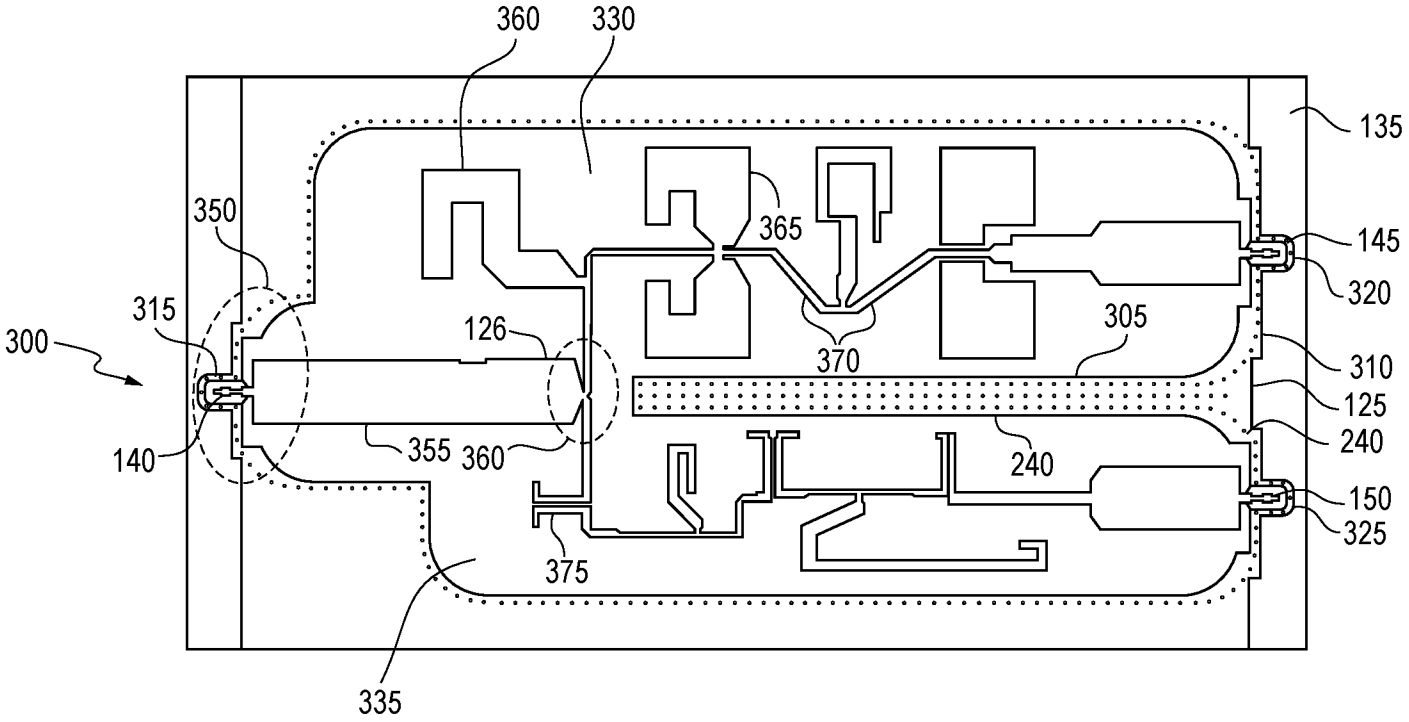
FIG. 3 shows a top view of metallization disposed on a top of a substrate relative to bottom side metallization.
Figure 4:
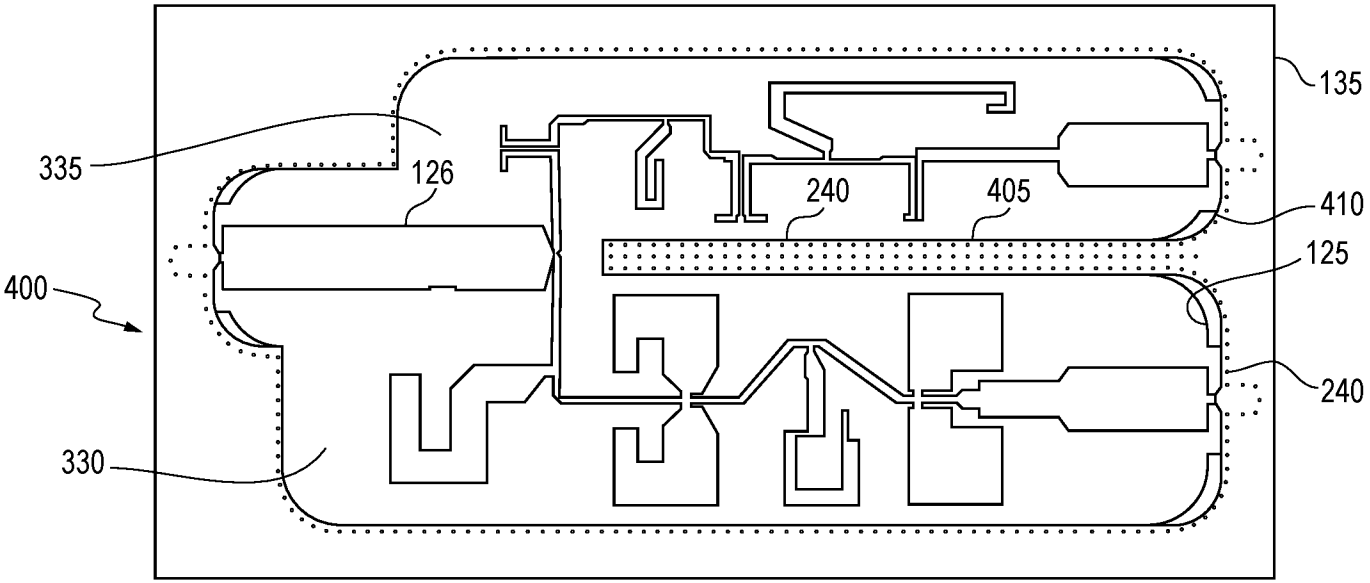
FIG. 4 shows a bottom view of metallization disposed on the bottom of the substrate relative to the top side metallization.

FIGS. 3 and 4 show top 300 and bottom 400 views of just the metallization that is disposed on top and bottom of a substrate, respectively. When assembled, the peninsula 155 engages the ground metallization on substrate 115 on one surface and the corresponding peninsula on the top enclosure engages the ground metallization on substrate 115 on the other surface so as to oppose peninsula 155 and, when interconnected by the through-substrate vias, form two parallel recessed cavities separated by two opposing peninsulas. The view as seen in FIG. 4 shows a bottom view of metallization on the bottom surface of the substrate with the view as shown in FIG. 3 rotated longitudinally 180°. The ground potential peninsula 305 is located on the top metal layer directly above the ground potential peninsula 405 on the bottom metal layer. A plurality of through-hole vias 310 in the top metal layer correspond to and are substantially identical with the through hole vias 410 in the bottom metal layer to establish a connection through the substrate between the top and bottom metal layers. A plurality of vias extend all along the width and length of the upper and lower metallization peninsulas in order to establish common ground potential between the top and bottom metal peninsula layers. A U-shaped metal loop 315 at ground potential extends around and completely encloses the input port 140. Similarly, U-shaped metal loops 320 and 325 of ground potential also enclose the output ports 145 and 150, respectively. This U-shaped loop is a feature in the probe-microstrip-stripline transition for the exemplary filter that helps minimize wave leakage in the space between the probe and the substrate going in the opposite direction to the desired direction (into the suspended stripline). Note that in other transition designs, e.g. ribbon bonding or dual-purpose (probing and ribbon bonding), utilizing a such a ground loop may not be needed or preferred. This ground loop is not a required feature of the current suspended stripline technology although it enhances a high performance wide band transition for probe-measuring.

Figure 7:
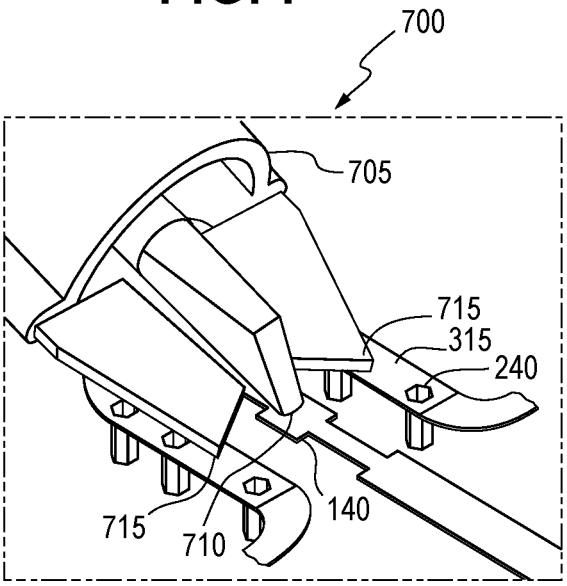
FIG. 7 shows an enlarged detail of topside metallization associated with the coupling of signals to and from the filter.

A general explanation of the circuitry implemented by the traces as shown in FIG. 3 is provided. However, those skilled in the art will understand that this explanation applies to the specific exemplary diplexer and that various other types of filter elements can be deployed on the substrate to provide frequency selective circuitry including transmission lines, inductive components, capacitive components, distributed components, and coupling components. Such components can be designed to provide various functions, e.g. low-pass filters, high-pass filters, bandpass filters and notch filters, etc. and can include multiple input and/or output ports. Additionally, active circuit elements, e.g. transistors, ICs, etc., could also be deployed on a supporting substrate contained within the enclosures. An input transition 350 facilitates a wide bandwidth accommodation between a microstrip contained between the probe as shown in FIG. 7 and strip line 355. If the microstrip and strip line both have 50-ohm transmission impedance, a representative microstrip will have a centerline conductor width of about 3 mil while the suspended strip line 355 will be 60 mil. Additionally, the electromagnetic field in the microstrip is mainly contained under the microstrip line while the electromagnetic field in the suspended strip line 355 spreads in all directions transverse to the direction of propagation, from the signal metal traces all the way to the interior walls of the covers. The transition 350 uses a wedge-shaped metallization on the bottom of the substrate and a contoured metal lining in the adjacent covers to assist in fanning out the field from the tightly confined microstrip mode to the substantially large cavity of the suspended strip line in a short distance. A tapering of the enclosure from a regular channel width down to the size of the opening 113 is designed to work with the wedge-shaped metallization for the same purpose of helping fan out the field for high performance wide band transition. Also, a neck-down matching section (see the narrowed section in FIG. 7) and a tail-end section behind the probe pad also help to achieve wideband performance for up to 40 GHz. The region 360 represents a common signal junction where the input signals are coupled by transmission line 355 to 2 transmission lines coupled to the top and bottom frequency selective circuitry, respectively. Elements 360, 365 and alike function as open stub transmission lines associated with tuning to provide a notch frequency response. Element 370 represents connecting transmission lines. The circuit elements residing above the transmission line 355 and peninsula 305 combine to provide a frequency response of a low-pass filter, e.g. 0.5 GHz-10 GHz signals are passed with low attenuation while signals with higher frequencies incur substantially attenuation, i.e. blocked/reflected at the beginning of the channel due to high impedance. Element 375 represents a coupled line providing a band-pass frequency response. The circuit elements residing below the transmission line 355 and peninsula 305 combine to provide a frequency response of a bandpass filter, e.g. signals within 11 GHz-20 GHz fall inside the bandpass frequency range and are coupled with low attenuation while frequencies outside the range, i.e. 0.5 GHz-10 GHz signals are substantially attenuated, i.e. blocked/reflected at the beginning of the channel due to high impedance.

As seen in FIG. 4, vias in the bottom metallization connect to the U-shaped ground loops to enhance the effective ground between the two metal layers. The top cavity 330 contains a plurality of metal traces 126 disposed in the top metal layer that function as selective frequency circuits to output port 145 where the selective frequency circuits provide low attenuation to signals between 0.5 GHz-10 GHz while providing a high impedance and substantial rejection to signals between 11 GHz-20 GHz. Similarly, the bottom cavity 335 contains a plurality of metal traces 126 disposed in the top metal layer that functions to form selective frequency circuits to output port 150 where the selective frequency circuits provide high impedance and substantial attenuation to signals between 0.5 GHz-10 GHz while providing low attenuation to signals between 11 GHz-20 GHz. Preferably, the substrate core is silicon carbide on which is disposed high precision metallization and through-wafer vias which can be produced using the same fabrication is used for gallium nitride (GaN) high electron mobility transistor (HEMT) production.

Figure 5:
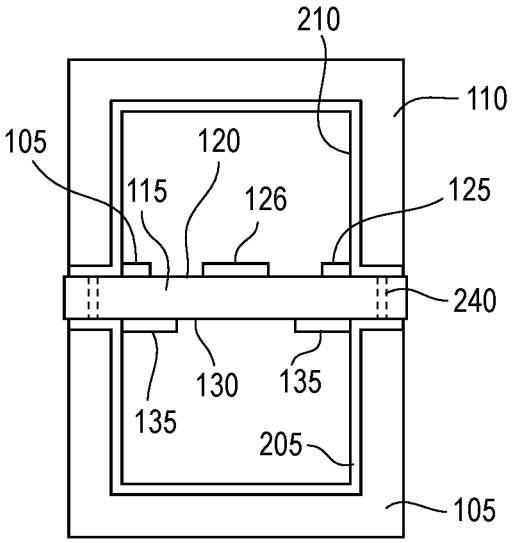
FIG. 5 shows a representative cross-section of an assembled filter in accordance with the embodiment of the present invention.

FIG. 5 shows a representative transverse cross-section of an assembled filter in accordance with the embodiment of the present invention where the cross-section is taken at location on the assembled filter where the peninsula 155 does not exist. The bottom enclosure 105 and the top enclosure 110 may be made of silicon with the interior surfaces 205 and 210 comprising a plated gold lining. The gold-plated surfaces of the bottom and top enclosures engage the bottom metallization 135 and the top metallization 125, respectively. A conductive via 240 through the substrate provides a continuous ground connection interconnecting the gold-plated cavities of the bottom and top enclosures as well as the top and bottom metal layers that are to be ground potential. The substrate 120 is preferably silicon carbide or another material having properties that change very little with temperature in order to minimize any frequency response variation with changes in temperature. The suspended strip line circuitry having a large cross-section filled with low loss material (air, silicon carbide) facilitates a very high Q, enabling low loss filters with sharp band edges and rejection roll-off.

Figure 6:
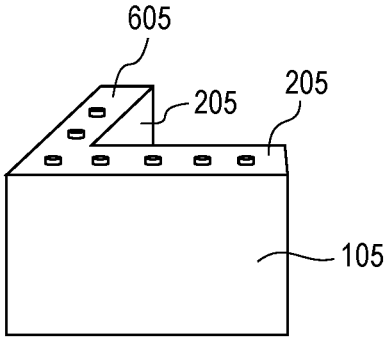
FIG. 6 shows an enlarged corner of an exemplary enclosure in accordance with an embodiment of the present invention.

FIG. 6 shows a representative enlarged corner of the bottom enclosure 105 with metal plating 205 that is disposed on the vertical sidewalls as well as the upward facing planar surfaces. Bonding bumps 605 extend generally perpendicular and outward from the upward facing planar surface along the peripheral edges and along the interior peninsula. Bonding bumps 605 are spaced apart along the entire periphery of the bottom enclosure and engage with the bottom metallization 135 in the assembled position. The bonding bumps also extend along the peninsula 155 of the bottom enclosure and engage the bottom metallization 405 in the assembled position. Similarly, bonding bumps extend perpendicular and outward from the downward facing planar surfaces of the top enclosure and engage the ground metallization 125 and ground peninsula metallization 305. In this example, the bonding bumps are formed on the enclosures rather than on the substrate (or metallization on the substrate) however it is potentially possible for the bonding bumps to be formed on both sides of the substrate 115. The bonding process preferably uses the highly accurate thermal compression bonding using a tool such as the FC-300 manufactured by SET for bonding of the gold-plated bonding bumps to the gold-plated metallization surfaces on the substrate. If the bonding bumps were disposed on the substrate, the second side to be bonded would have a much higher density of bumps so that the opposing bonding bumps on the other side of the substrate to be used for the other of the bottom and top enclosures would not be crushed during the process of applying pressure to create the bonding of the first enclosure to the substrate.

FIG. 7 shows an enlarged detail 700 of topside metallization associated with ports 140, 145 and 150 used to couple signals to and from the filter. These three ports are designed for probe-measuring. As an example, the port 140 is a ground-signal-ground port used to couple the input signal. As seen in this detail, the U-shaped ground metallization 315 provides a continuous 270° encircling of the input port center conductor 140. In this example an external probe or interconnect 705 includes a center metal conductor (finger) 710 disposed to engage the input port center conductor 140 and includes two opposing metal fingers 715 on either side of center finger 710 disposed to engage opposite legs of the U-shaped ground metallization 315. This structure of the ports provides the necessary compensation features such as inductance and capacitance in close proximity that allows a smooth transition of the field in the probe to that on the signal carrying traces on the substrate, and hence forming a "transition" from the probe to the brief microstrip (i.e., a transmission line with ground metallization on the backside of a substrate) and to the suspended stripline.

Figure 8:
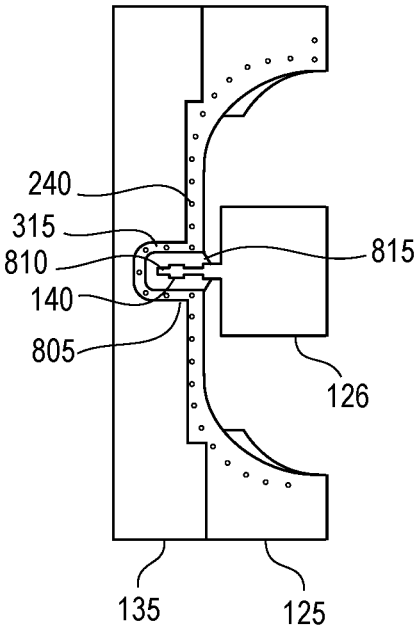
FIG. 8 shows an exploded detail view of the structure that supports a high-performance transition between an external microstrip transmission line and the suspended strip line in the embodiment of the present invention.

FIG. 8 shows an exploded detail view of the structure that supports a compact, high performance wide-band transition between an external microstrip line and the suspended strip line in the embodiment of the present invention. The field in the probe tip is between the signal pin and the ground pins, in a horizontal direction. To receive the pressure from probe landing, the lower cover must not have excavation in this region, and as such, microstrip type of transmission line, i.e., one with metallization (ground) at the backside of the substrate, must be used near the probe landing area. The vias 240 and the ground loop 315 help "folding" or "bending" the essentially horizontal field at the probe tip to the essentially vertical field under the microstrip trace. The neck-down 805 next to the probe pad 140 and the tail-end piece 810 are both features that help impedance match for wide-band performance. Next is the junction between the microstrip and the strip line where the essentially vertical field concentrated under the microstrip trace must fan out to all direction (downwards, upwards, sideways, etc.) in the suspended strip line that has an order of magnitude larger cross section than the microstrip. This field fan-out is assisted by the following features. The wedge-shaped metallization 815 on the backside of the substrate can be viewed as a "diving board" that allows the concentrated microstrip field to gradually loosen up and make connection to the much larger ground structure in the strip line. The tapering of both top and bottom covers provides to the field lines a landing surface in close proximity near the microstrip-stripline juncture and gradually expands the landed field to a larger cross section until it fills the full channel dimensions. It should be noted that due to the small distance and hence strong interactions between the probe-to-microstrip transition and the microstrip-to-stripline transition, these should be viewed and designed as a single transition, i.e., the probe-microstrip-stripline transition. Other transitions have also been designed for practical purposes such as for ribbon bonding or ribbon bonding and probing. Those transitions may have different dimensions or ground via arrangement. But the essential field bending/expanding features such as the wedge and the tapering ground remain very effective.

Figure 9A:
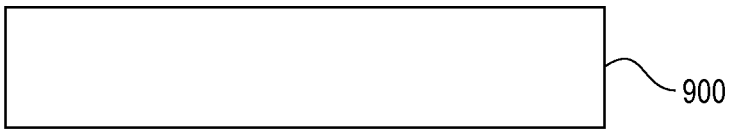
FIGS. 9A-9G show processing steps for manufacturing the exemplary enclosures.
Figure 9B:
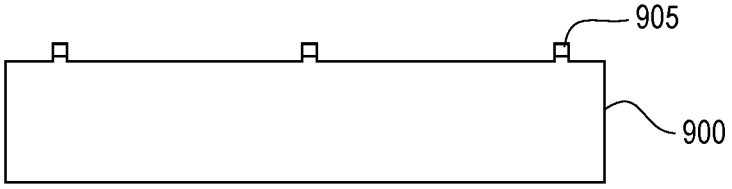
Figure 9C:
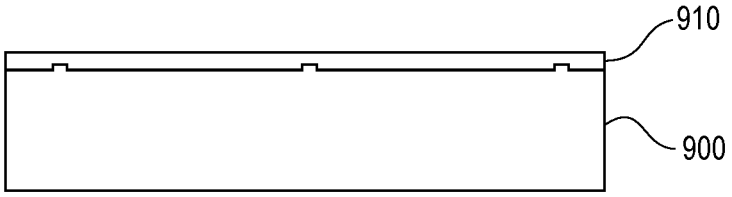
Figure 9D:
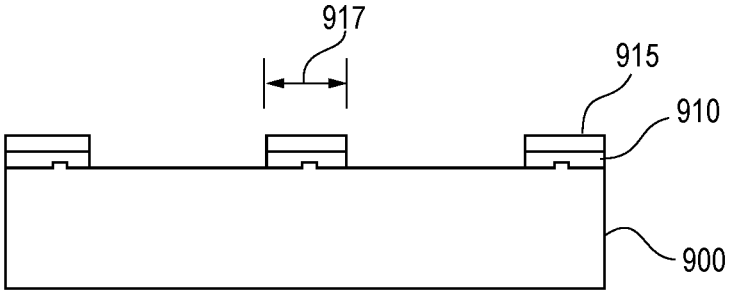
Figure 9E:
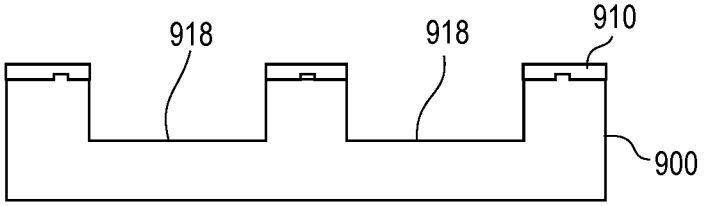
Figure 9F:
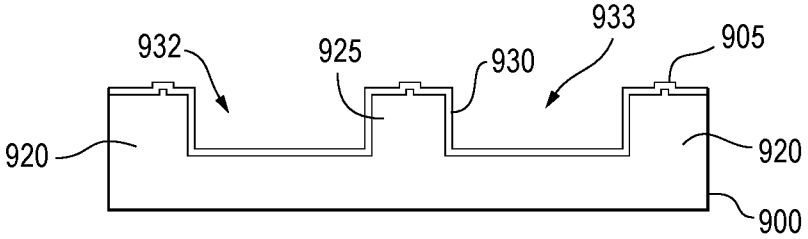
Figure 9G:
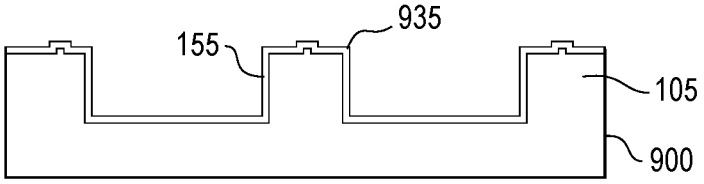

FIGS. 9A-9G show processing steps for manufacturing an exemplary enclosure associated with the filter in accordance with an embodiment of the present invention. In this example, the exemplary cross-section of a lower enclosure 105 is shown at a location so that the peninsula wall 155 is also shown. In FIG. 9A the process begins with a relatively thick silicon wafer 900, e.g. 1 mm. In a next step as shown in FIG. 9B the top surface of the silicon wafer 900 is patterned with photoresist and reactive ion etching (ME) is used to micromachine regions of the silicon to be removed, i.e. leaving the outwardly extending bonding bumps 905. "Micromachining" refers to creating a dimensionally accurate and smooth surface by semiconductor etching followed by deposition of a layer of metal. In the next step shown in FIG. 9C the photoresist is removed and a layer of oxide 910 is deposited with a thickness adequate to resist complete erosion during the silicon etching. Then, as shown in FIG. 9D photoresist pattern 915 is applied to create what will become three walls 917 and RIE is used to etch away the oxide 910 not protected by the photoresist. As shown in FIG. 9E the photoresist 915 as shown in FIG. 9D is removed and deep RIE etching is used to remove regions of the silicon that will form the interior recesses 918 in the enclosure. In FIG. 9F the oxide 910 is removed revealing 2 longitudinal walls 920 along the longitudinal edges and a centered, longitudinal peninsula wall 925 that form two separated longitudinal recesses 932, 933. The recesses may be up to approximately 40 mils deep with the exemplary diplexer embodiment etched to a depth of 15 mils. This is followed by sputtering a relative thin layer of gold 930 across all of the exposed upward facing surfaces including associated ends of the walls, bonding bumps, vertical walls and planar recesses. Thus, the exposed ends of the walls 920 and 925 as well as the bonding bumps and recess areas are all sputtered with gold. In the final step as shown in FIG. 9G all of the areas previously sputtered with gold are now plated with a thicker layer of gold. In this example, bonding bumps have a diameter of 25 μm, a bump height of 1.6 μm and are preferably spaced apart by a distance of 200 μm. Usually the maximum spacing is about a quarter wavelength but a tenth of a wavelength is preferred, if feasible.

The superior degree of dimensional accuracy, and the surface smoothness of the interior recesses and surfaces interior of the enclosures achieved by the micromachining is critical to the ability to manufacture filters that have highly repeatable characteristics and performance and that have low electrical loss. Enclosures made by traditional mechanical manufacturing techniques such as machining, EDM, electroform, etc., have a tolerance in the range of 0.2 mils to 1 mil, which is one to two orders of magnitude larger than the precision provided by the semiconductor technology described herein. Additionally, surface roughness from machining may typically be 5 times higher than roughness achieved by semiconductor technology, which leads to additional RF signal loss. For example, the micromachined interior surfaces in the exemplary enclosures have a peak to valley roughness of less than 2 μm, i.e. 1.3 μm, as compared to a machined copper housing with a peak to valley roughness of about 9.4 μm. This provides a more than 7 times improvement in smoothness.

Although a conductive epoxy paste can be utilized to achieve assembly of the silicon and SiC, the conductive paste provides a more difficult technique to control in terms of ooze-out, thickness variation, air voids and poor electrical contact, etc., as well as placement accuracy.

With respect to the vias, 50 μm diameter metallized through-wafer vias connecting ground metallization on opposing surfaces on the substrate are used to form high-isolation electromagnetic via fences. Simulation has indicated that the vias can be used to provide high isolation up to 100 GHz when spaced at a minimum of 100 μm pitch. The via fence and the gold-plated silicon enclosure walls allow individual elements of the two separated frequency circuits to be effectively put into their own electromagnetically shielded cavities to minimize cross coupling. The through-wafer vias promote substantially continuous ground continuity for the RF return currents between the top and bottom enclosures and enables probe testing of the filter after fabrication. It should be noted that the "wall" formed by the gold-plated silicon enclosure walls and the via fence not only can be used to isolate channels, but also can be used to isolate individual filter elements. Traditional open-face printed filter designs often incurs longer design cycles because proximity coupling among filter elements makes guesswork and repeated simulation cycles inevitable in fine-tuning the filter geometry. Isolation between individual filter elements eliminates such undesired cross coupling and hence allows for rapid development and compact layout.

As seen in Table 1, tight fabrication tolerances are important to design success on a first pass and to manufacturing repeatability, especially for filters which require tight cutoff specifications, high isolation requirements, and highly repeatable performance.

TABLE 1

| | | |
|---|---|---|
| SIGNAL LINE PRECISION ON SUBSTRATE | LINEWIDTH | +/−1 μm |
| | METAL THICKNESS | 3.5 or 5.5 μm, +/−0.5 μm |
| SILICON DRIE CAVITY PRECISION | CAVITY WIDTH | +/−3 μm |
| | CAVITY DEPTH | up to 40 mil, +/−10 μm |
| ALIGNMENT OF SUBSTRATE TO ENCLOSURES | | +/−5 μm |

Figure 10:
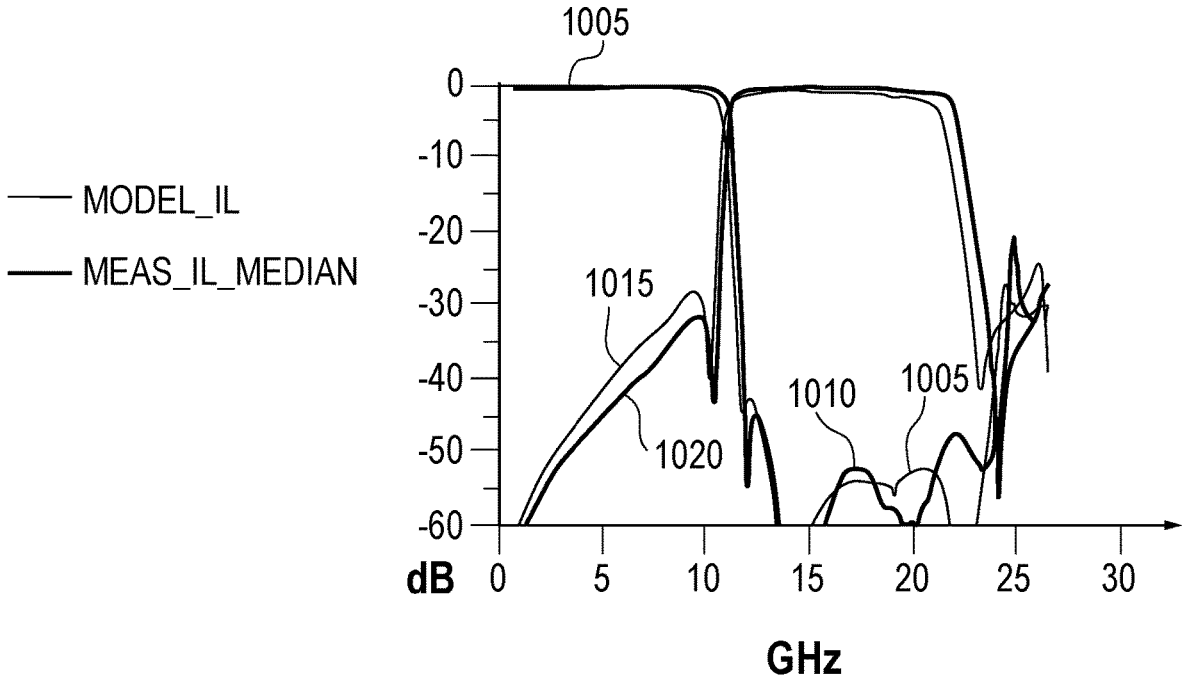
FIG. 10 shows a graph illustrating performance characteristics of an exemplary filter over a frequency range in accordance with an embodiment of the present invention.

FIG. 10 shows a graph illustrating performance characteristics over a frequency range of the exemplary filter (diplexer). This graph is plotted as dB versus frequencies for the exemplary frequencies of interest, i.e. 0.5 GHz-25 GHz. Line 1005 represents the output characteristics associated with signals from output port 145 that shows very low loss for input signals between 0.5 GHz and 10 GHz with a sharp increase of attenuation at approximately 11 GHz resulting in the attenuation of approximately 50 dB from about 12 GHz-24 GHz. Line 1010 represents the projected characteristics for signals at output port 145 using the finite element frequency domain analysis tool "HFSS" from ANSYS, Inc. It will be apparent that an extremely close correspondence exists between the projected characteristics and the actual measured characteristics. This is due to the tight manufacturing tolerances discussed above. Line 1015 represents the output characteristics associated with signals from output port 150 that shows very low loss for signals between 11 GHz and 20 GHz with a sharp increase at approximately 11 GHz resulting in the attenuation of at least 30 dB (and greater with decreasing frequency) from about 10 GHz-0.5 GHz. Line 1020 represents the projected characteristics for signals at output port 150 using the same HFSS model as mentioned above. Again, it will be apparent that an extremely close correspondence exists between the projected characteristics and the actual measured characteristics. The close correspondence between the characteristics projected by model analysis and actual measured characteristics of fabricated diplexers on a first pass of manufacturing represents outstanding design and fabrication techniques. The unit to unit variations of first pass fabricated diplexers was also remarkable, with 7 of 8 fabricated units showing nearly identical performance.

Although exemplary implementations of the invention have been depicted and described in detail herein, it will be apparent to those skilled in the art that various modifications, additions, substitutions, and the like can be made without departing from the spirit of the invention. For example, other microwave circuits including those mentioned in paragraph [18] can be realized. The silicon cavity can be different heights and the bonding bumps can be made using various chip and wafer bonding techniques including eutectic bonding such as indium-gold or gold-tin, or copper pillar bonding. The bonding bumps could be fabricated on the substrate 115 instead of the silicon and the assembly can be bonded as an entire wafer rather than in smaller filter-sized blocks. The cavity height is only limited by the fabrication capability of the silicon etching tool. A silicon cavity with two different etch depths is possible and could be used in a terahertz waveguide device and could be used in the type of filter described herein. The substrate 115 could be made of another material such as 5 mil thick alumina, as long as there are through-wafer electrically conductive vias.

The scope of the invention is defined in the following claims.

We claim:

1. A semiconductor technology implemented microwave and millimeter wave filter comprising:

a substantially planar dielectric substrate;

metal traces disposed on at least one of two major surfaces of the substrate that function as frequency selective circuits and a reference ground;

other metal traces disposed on at least one of the two major surfaces of the substrate that function as the reference ground;

a bottom enclosure with at least one interior recess and outwardly extending peripheral walls that include a substantially first planar end area that is parallel to the substrate, all interior surfaces of the bottom enclosure including the substantially planar end area and the at least one interior recess having a deposited metal coating, the substantially first planar end area aligned with metal traces on the one major surface of the substrate that function as the reference ground;

a top enclosure with at least one interior recess and outwardly extending peripheral walls that include a substantially second planar end area that is parallel to the substrate, the substantially second planar end area aligned with metal traces on the one major surface of the substrate that function as the electrical ground, all interior surfaces of the top enclosure including the substantially planar end area of the top enclosure and the at least one interior recess having a deposited metal coating; and a plurality of metal bonding bumps that extend outwardly from the first and second substantially planar end areas, the metal bonding bumps on the bottom and top enclosures engaging the respective reference ground metal traces on the one major surface and the other major surface to form metal-to-metal conductive bonds to establish a common reference ground with the deposited metal coatings of the bottom and top enclosures.

2. The filter of claim 1 wherein the substrate is silicon carbide and the deposited metal coating is gold.

3. The filter of claim 1 further comprising projecting longitudinal peninsulas on the bottom and top enclosures near a longitudinal center line separates respective first and second longitudinal recesses in the interior of the bottom and top enclosures, the longitudinal peninsulas having a substantially planar end area, a plurality of metal bonding bumps extend outwardly from the substantially planar end area of the longitudinal peninsulas and engage reference ground metal traces on the one major surface and the other major surface to electromagnetically separate frequency selective circuits on one side of the longitudinal peninsulas from other frequency selective circuits on the other side of the longitudinal peninsulas.

4. The filter of claim 3 wherein the reference ground metal traces on both major surfaces are longitudinal and on opposing major surfaces of the substrate, and further comprising a plurality of closely spaced, contiguous, through-hole conductive vias that interconnect the longitudinal reference ground metal traces to establish a common reference ground, the plurality of vias in combination with the conductive longitudinal peninsulas electromagnetically separating frequency selective circuits on one side of the longitudinal peninsulas from other frequency selective circuits on the other side of the longitudinal peninsulas by a common ground.

5. The filter of claim 1 further comprising a row of closely spaced, contiguous, through-hole conductive vias disposed in the substrate near an edge defining an interior periphery of the recesses.

6. The filter of claim 1 wherein the interior surfaces of the bottom and top enclosures are formed by micromachining a wafer to dispose a deposited metal having a peak to valley roughness of less than 2 microns.

7. The filter of claim 1 further comprising the metal traces including a stripline for carrying an input signal, and means for minimizing impedance changes between the stripline and a microstrip that couples the input signal to the stripline.

8. A method for manufacturing enclosures for a semiconductor technology implemented microwave and millimeter wave frequency filter having frequency selective circuitry disposed on a substrate that contains reference ground metal traces on each major surface, the substrate contained as a sandwich between two such enclosures, the method comprising the steps of:

applying a first pattern of photoresist on a first surface of a silicon wafer where the first pattern is a plurality of spaced apart small areas disposed within areas of the silicon wafer that will define the ends of walls of the enclosures;

etching away a layer of silicon not protected by the first pattern of photoresist, a plurality of extending bumps rising above the bottom of the removed layer corresponds to the areas of the first pattern of photoresist;

removing the first pattern of photoresist that covers the bumps;

depositing an oxide coating to cover the surface of the silicon wafer including the extending bumps;

applying a second pattern of photoresist on the oxide coating where the second pattern covers areas that define where walls will extend from the enclosures, the plurality of extending bumps residing within the second pattern;

etching away the deposited oxide coating not protected by the second pattern of photoresist;

removing the second pattern of photoresist that covers areas that will define the walls;

etching away a layer of the silicon wafer except for the areas with the oxide coating that define the walls, the etched away layer of silicon forming at least one interior recess in the silicon wafer;

removing the oxide coating from the areas that define the ends of the walls and the bumps;

sputtering the entirety of the exposed surface of the silicon wafer with gold so that sputtered gold coats the ends of the walls, the bumps on the ends of the walls, at least one interior recess in the silicon wafer, and the interior sides of the walls; and plating the area covered by sputtered gold with gold.

9. The method of claim 8 wherein the step of applying a second pattern of photoresist on the oxide coating comprises applying the photoresist over areas to define two longitudinal walls near the respective longitudinal edges of the wafer and at least one interior longitudinal wall.

10. The method according to claim 8 further comprising the surface of the plated gold in the recess having a peak to valley roughness of less than 2 μm.

11. The method according to claim 8 wherein the bumps have a diameter that is less than the width of the ends of the walls of the enclosure and a height adapted to forming a metal-to-metal conductive bond under applied pressure with metal traces on the substrate.

12. The method according to claim 8 wherein the plating of the gold applies a layer of gold at least 3 μm thick.

13. The method according to claim 8 wherein the bump to bump spacing is less than ⅕ of a quarter wavelength of the highest frequency in use.

14. The method according to claim 8 wherein the etching is reactive ion etching.

15. The method according to claim 8 wherein the last etching step is deep reactive ion etching.

* * * * *